US011610258B2

(12) United States Patent
Takahashi et al.

(10) Patent No.: US 11,610,258 B2
(45) Date of Patent: Mar. 21, 2023

(54) AUCTION SYSTEM OF ELECTRIC VEHICLE

(71) Applicant: TOYOTA JIDOSHA KABUSHIKI KAISHA, Toyota (JP)

(72) Inventors: Masashi Takahashi, Nagoya (JP); Makoto Kakuchi, Toyota (JP); Yoichi Onishi, Okazaki (JP); Kenji Kimura, Nagoya (JP); Masakazu Habu, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/401,518

(22) Filed: Aug. 13, 2021

(65) Prior Publication Data

US 2022/0108386 A1 Apr. 7, 2022

(30) Foreign Application Priority Data

Oct. 5, 2020 (JP) ..... JP2020-168428

(51) Int. Cl.
*G06Q 30/08* (2012.01)

(52) U.S. Cl.
CPC ..... *G06Q 30/08* (2013.01)

(58) Field of Classification Search
CPC ..... G06Q 30/08
See application file for complete search history.

(56) References Cited

U.S. PATENT DOCUMENTS

| | | | | |
|---|---|---|---|---|
| 2009/0024266 | A1* | 1/2009 | Bertness | G07C 5/0808 701/22 |
| 2012/0037473 | A1* | 2/2012 | Ouwenga | F02B 33/38 192/84.9 |
| 2012/0130843 | A1* | 5/2012 | Himmerick | G06Q 30/08 705/26.3 |
| 2014/0164162 | A1* | 6/2014 | Rabenold | G06Q 30/08 705/26.3 |
| 2018/0218449 | A1* | 8/2018 | Holmberg | G06Q 30/08 |
| 2019/0156408 | A1 | 5/2019 | Igata et al. | |
| 2019/0156409 | A1 | 5/2019 | Igata et al. | |
| 2021/0120297 | A1* | 4/2021 | Deshpande | G06F 16/9535 |

FOREIGN PATENT DOCUMENTS

| | | | |
|---|---|---|---|
| JP | 3273935 | B2 | 4/2002 |
| JP | 2013-084199 | A | 5/2013 |
| JP | 2019-095988 | A | 6/2019 |
| JP | 2019-095990 | A | 6/2019 |

* cited by examiner

*Primary Examiner* — Asha Puttaiah
(74) *Attorney, Agent, or Firm* — Oliff PLC

(57) ABSTRACT

A computer of an auction system presents vehicle body quality information indicating a quality of a vehicle body excluding a battery of an electric vehicle and battery quality information, and receives an electric vehicle bid price, a vehicle body bid price, and a battery bid price. When a total of the vehicle body bid price and the battery bid price exceeds the electric vehicle bid price, the computer determines a battery purchase applicant who presents the battery bid price as a winning bidder of the battery, and a vehicle body purchase applicant who presents the vehicle body bid price as a winning bidder of the vehicle body. When the total is lower than the electric vehicle bid price, the computer determines an electric vehicle purchase applicant who presents the electric vehicle bid price as a winning bidder of the electric vehicle.

3 Claims, 4 Drawing Sheets

AUCTION SYSTEM OF ELECTRIC VEHICLE

CROSS-REFERENCE TO RELATED APPLICATION

This application claims priority to Japanese Patent Application No. 2020-168428 filed on Oct. 5, 2020, incorporated herein by reference in its entirety.

BACKGROUND

1. Technical Field

The present disclosure relates to an auction system for an electric vehicle having a battery mounted thereon.

2. Description of Related Art

An electric vehicle includes a traveling motor and a battery that supplies electric power to the motor. In the present specification, the battery is a rechargeable secondary battery. The rate of deterioration of a battery in an electric vehicle varies greatly depending on how the battery is used. The quality of the battery has a great influence on an evaluation value of the electric vehicle. The same applies to a used electric vehicle. A technology for determining an evaluation value of an electric vehicle in consideration of a state of a battery is disclosed in Japanese Unexamined Patent Application Publication No. 2019-95988, Japanese Unexamined Patent Application Publication No. 2019-95990, and Japanese Unexamined Patent Application Publication No. 2013-84199.

Japanese Patent No. 3273935 proposes an auction system of a used vehicle. An electric vehicle having a traveling motor and a battery mounted thereon can also be exhibited for an auction. An evaluation value of the electric vehicle exhibited at the auction also depends on the quality of the battery. In the present specification, examples of the "electric vehicle" include a hybrid vehicle having a traveling motor and an engine mounted thereon, and a vehicle including a secondary battery and a fuel cell as power sources for a motor.

SUMMARY

A quality of a used battery depends on the frequency of charging, changes in an amount of remaining power (state of charge: SOC), and the like. These parameters have little correlation with the quality of a vehicle body excluding the battery. In other words, the quality of the vehicle body (the vehicle body excluding the battery from the electric vehicle) can be high, but the quality of the battery can be low. When the quality of the battery is low, it is possible to obtain a high evaluation value for the vehicle body only excluding the battery but not possible to obtain a high evaluation value for the entire electric vehicle including the battery. The evaluation value of the entire electric vehicle is influenced by the low quality of the battery, and thus there is a concern that a market price of a used electric vehicle may drop excessively. An auction system that can trade the vehicle body excluding the battery and the battery at appropriate prices, respectively, is desirable.

In an auction system disclosed in the present specification, a computer (an auction computer) executes the following processing. The auction computer presents a computer of a bidder (a bidding computer) with vehicle body quality information indicating the quality of a vehicle body excluding a battery of an electric vehicle, and battery quality information indicating the quality of the battery. The auction computer receives, from the bidding computer, an electric vehicle bid price indicating a bid price of the electric vehicle including the battery, a vehicle body bid price indicating a bid price of the vehicle body excluding the battery, and a battery bid price indicating a bid price of the battery. When a total of the vehicle body bid price and the battery bid price exceeds the electric vehicle bid price, the auction computer determines a battery purchase applicant who presents the battery bid price as a winning bidder of the battery, and a vehicle body purchase applicant who presents the vehicle body bid price as a winning bidder of the vehicle body. On the other hand, when the total of the vehicle body bid price and the battery bid price is lower than the electric vehicle bid price, the auction computer determines an electric vehicle purchase applicant who presents the electric vehicle bid price as a winning bidder of the electric vehicle. In the present specification, quality information includes information with which the progress of deterioration (for example, a full charge amount of the battery, an output voltage at the time of full charge, the total mileage of the vehicle body) can be grasped. By adopting the auction system disclosed in the present specification, it is possible to trade the vehicle body excluding the battery and the battery at appropriate prices, respectively.

The auction system receives a plurality of bid prices. For convenience of description, the above "bid price" means a bid price indicating the highest bid price from among a plurality of bid prices. The "electric vehicle bid price" means the highest bid price from among a plurality of bid prices of the electric vehicle. The "vehicle body bid price" means the highest bid price from among a plurality of bid prices of the vehicle body (the vehicle body excluding the battery from the electric vehicle). The "battery bid price" means the highest bid price from among a plurality of bid prices of the battery.

There is a case where it is difficult for an exhibitor of the electric vehicle to properly grasp the quality of the battery. On the other hand, it is conceivable that a management device of the electric vehicle constantly monitors the quality of the battery. The management device stores battery quality information in association with an identifier assigned to the electric vehicle. In such a case, the auction system may receive the identifier of the electric vehicle, transmit the identifier to the management device of the electric vehicle, and acquire, from the management device, the battery quality information associated with the identifier. It is possible to present an auction participant with detailed information on the quality of the battery.

The auction system may present a quality rank indicating the degree of deterioration of the battery. The quality rank is determined based on the battery quality information.

Details of the technology and further improvements disclosed in the present specification will be described in "DETAILED DESCRIPTION OF EMBODIMENTS" hereinbelow.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Figure 1:
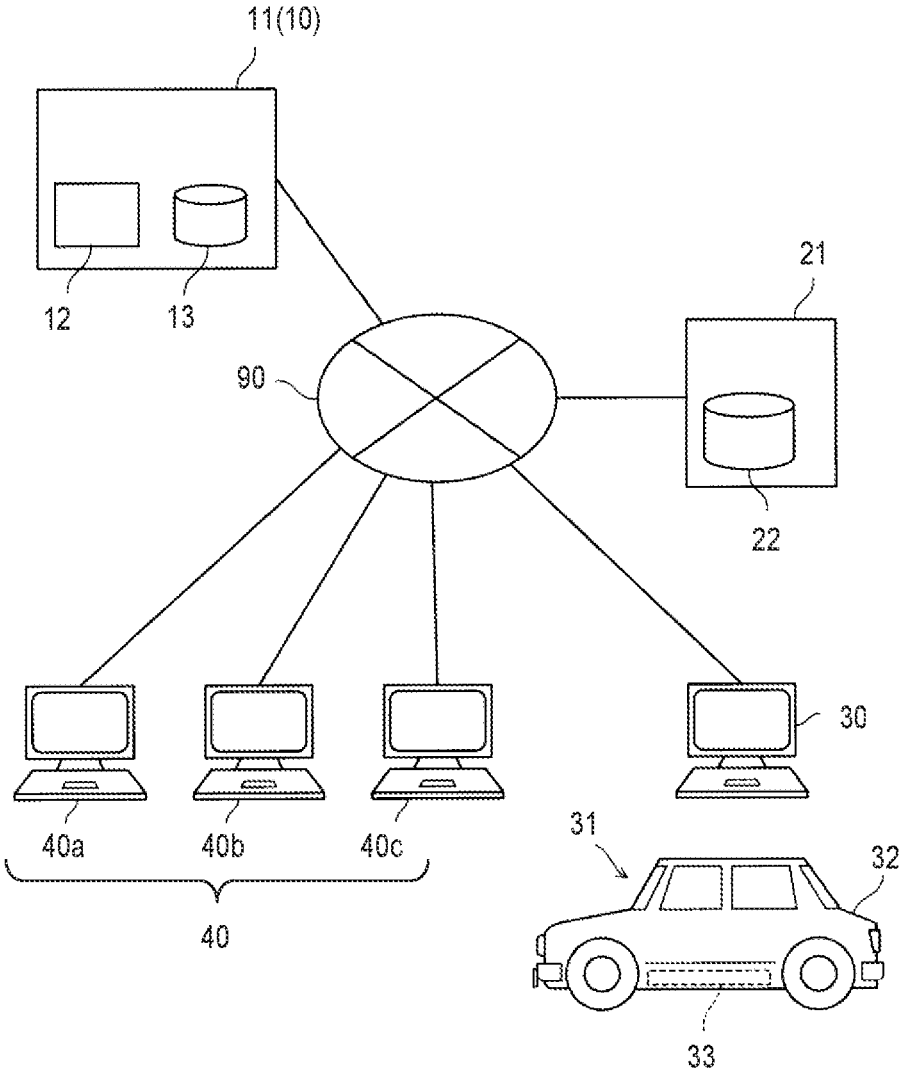
FIG. 1 is a block diagram of an auction system according to an embodiment.

An auction system 10 according to an embodiment will be described with reference to the drawings. FIG. 1 illustrates a block diagram of the auction system 10 and various computers connected to the auction system 10 via a network 90 (the Internet). An actual form of the auction system 10 is a program implemented in an auction computer 11. The auction computer 11 includes a central processing unit 12 (CPU) and a memory 13, and when the CPU 12 executes an auction program stored in the memory 13, the auction computer 11 functions as the auction system 10.

In addition to the auction computer 11, the network 90 is connected to a vehicle information computer 21, a computer of an exhibitor (an exhibition computer 30) that exhibits an electric vehicle 31 in the auction system 10, computers (bidding computers 40*a* to 40*c*) of purchase applicants who desire to purchase an item exhibited in the auction system 10, and the like. The number of bidding computers may be singular or plural. When a plurality of (or a single) bidding computers is collectively referred to, they may be referred to as bidding computers 40. The exhibition computer 30 and the bidding computers 40 participating in the auction system 10 may be smartphones or tablet-type computers.

When the electric vehicle having a battery mounted thereon is exhibited, the auction system 10 auctions the battery alone, a vehicle body of the electric vehicle excluding the battery, and the electric vehicle including the battery, respectively. When a total of a bid price of the battery alone and a bid price of the vehicle body alone is higher than the bid price of the electric vehicle including the battery, it is advantageous for the exhibitor to sell the battery and the vehicle body separately. Here, the "bid price" means the highest bid price from among a plurality of bid prices. Further, the battery of the electric vehicle in the present specification means a battery that supplies electric power to a traveling motor and a rechargeable secondary battery.

Hereinbelow, it will be assumed that the exhibitor exhibits, in the auction, the electric vehicle 31 having a battery 33 mounted on a vehicle body 32. The electric vehicle 31 communicates with the vehicle information computer 21 regularly (or irregularly), and transmits information on the quality of the electric vehicle 31 to the vehicle information computer 21. The information on the quality of the electric vehicle 31 includes information on the quality of the battery 33 and information on the quality of the vehicle body 32 (the electric vehicle 31 excluding the battery 33). The former is referred to as battery quality information, and the latter is referred to as vehicle body quality information. A unique identifier (a vehicle identifier) is assigned to the electric vehicle 31, and the electric vehicle 31 transmits the vehicle body quality information and the battery quality information together with the vehicle identifier to the vehicle information computer 21. The vehicle information computer 21 stores the vehicle body quality information and the battery quality information in the database 22 in association with the vehicle identifier.

The vehicle body quality information includes the total mileage, routes traveled so far, a history of acceleration/deceleration, and the like. When the electric vehicle 31 receives maintenance, a staff member in charge of the maintenance transmits a maintenance state (replacement or a damage condition of the vehicle body 32) to the vehicle information computer 21 together with the vehicle identifier.

The battery quality information includes the number of times of charging, an amount of electric power immediately before charging, an amount of electric power immediately after charging, an output voltage immediately after charging, an interval of charging, and the like. When the electric vehicle 31 receives maintenance, the staff member in charge of the maintenance transmits a maintenance state of the battery 33 (a damage condition of the battery 33 and the like) to the vehicle information computer 21 together with the vehicle identifier.

The battery 33 may be transferred to and mounted on another electric vehicle. In that case, the battery quality information of the battery 33 is associated with an identifier of the new electric vehicle. In addition, the battery quality information also includes quality information when it has been mounted on a previous electric vehicle. By referring to the battery quality information associated with the vehicle identifier, a usage history of the battery becomes clear. In other words, by referring to the battery quality information, the degree of deterioration of the battery 33 is discovered. Similarly, by referring to the vehicle body quality information, the degree of deterioration of the vehicle body 32 is discovered.

Figure 2:
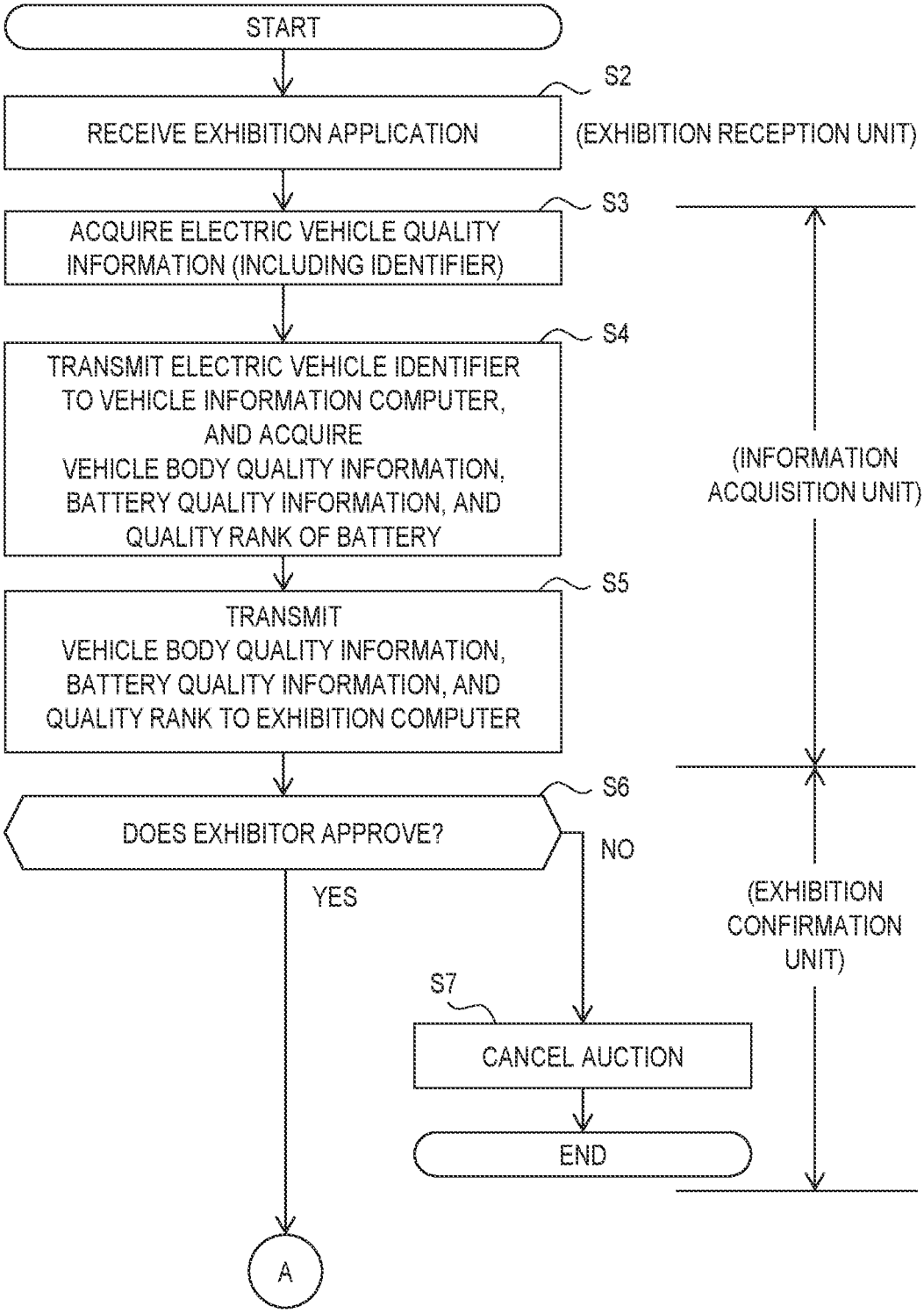
FIG. 2 is a flowchart of processing executed by the auction system.
Figure 3:
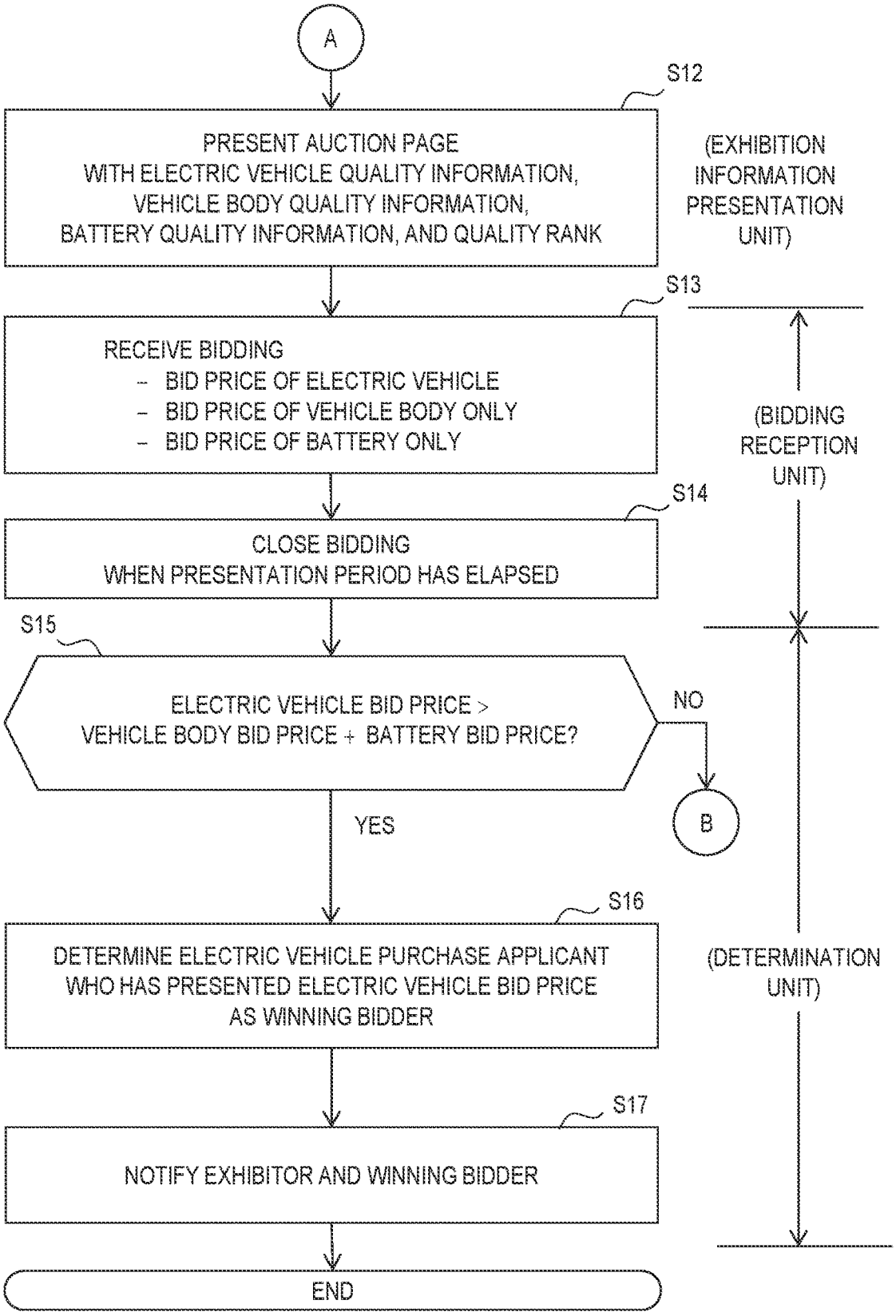
FIG. 3 is the flowchart of the processing executed by the auction system (continuation of FIG. 2)
Figure 4:
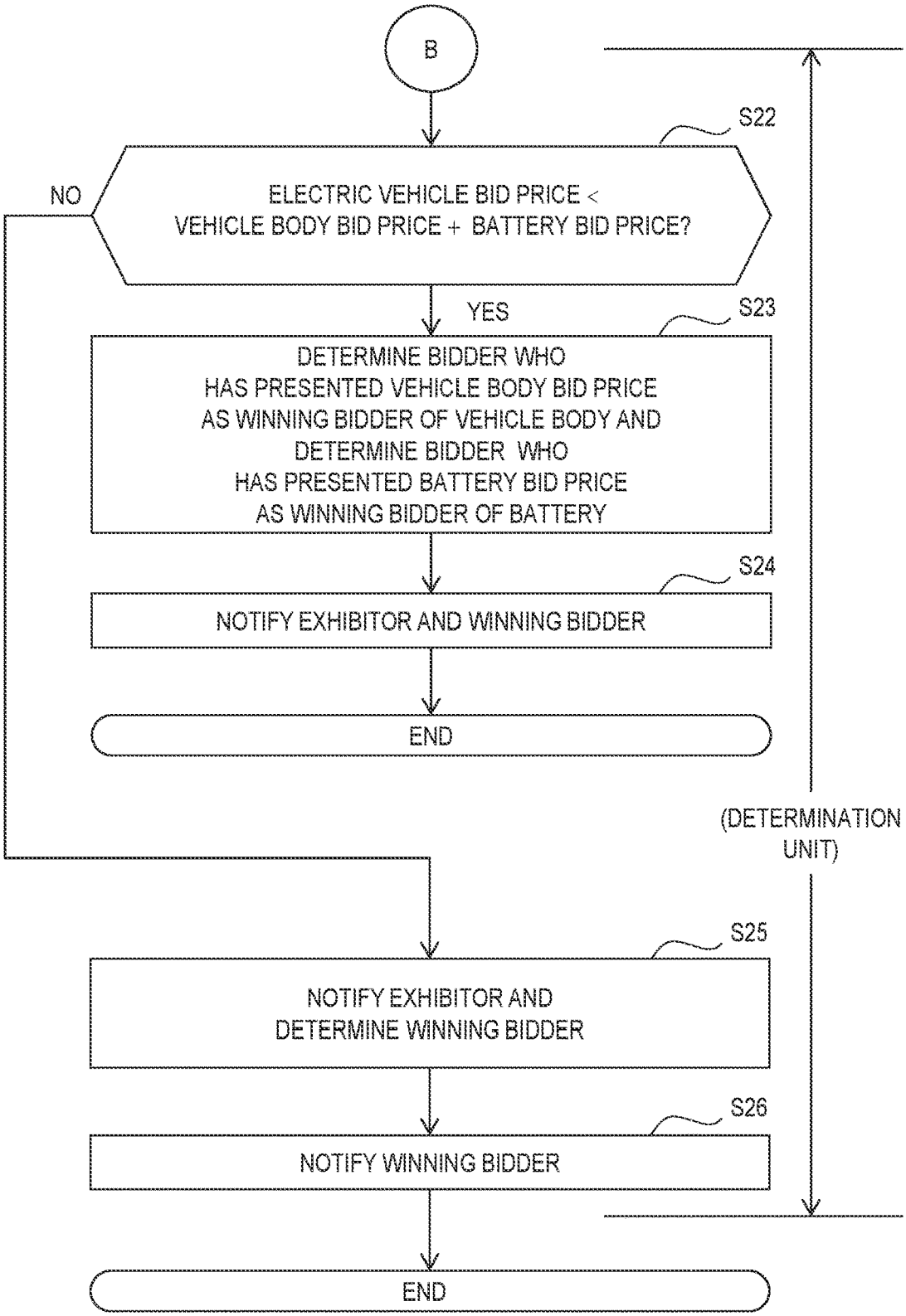
FIG. 4 is the flowchart of the processing executed by the auction system (continuation of FIG. 3).

A flow of the auction program executed by the auction computer 11 will be described with reference to FIGS. 2 to 4. The auction computer 11 (that is, the auction system 10) discloses a homepage that executes an auction. The exhibitor and the purchase applicant of the exhibited item exchange information with the auction computer 11 via the homepage.

The exhibitor of the electric vehicle 31 operates the exhibition computer 30 and applies for an exhibition of the electric vehicle 31. The auction computer 11 receives the exhibition application for the electric vehicle 31 (step S2). At this time, the auction computer 11 functions as an exhibition reception unit.

The auction computer 11 acquires information on the quality of the electric vehicle 31 from the exhibitor via the exhibition computer 30 and the network 90 (step S3). This information is referred to as electric vehicle quality information. Moreover, when the process of step S3, and processes of steps S4 and S5, that will be described below, are executed, the auction computer 11 functions as an information acquisition unit. The electric vehicle quality information includes information that the exhibitor knows about the electric vehicle 31, such as the body color, mileage, registration year, and maintenance history of the electric vehicle 31. The electric vehicle quality information also includes an image of the electric vehicle 31. Further, the electric vehicle quality information also includes an identifier (a vehicle identifier) of the electric vehicle 31.

The vehicle information computer 21 manages the battery quality information of each of a large number of batteries. The degree of deterioration of the secondary battery can be evaluated by, for example, the amount of electric power and the output voltage at the time of full charge. The vehicle information computer 21 refers to data on the amount of electric power and the output voltage at the time of full charge from each of a large number of pieces of battery quality information managed by the vehicle information computer 21 itself, and determines the quality rank indicating the degree of deterioration of each battery. For example, in the vehicle information computer 21, a battery having extremely little deterioration is classified into rank A and a battery having extremely large deterioration is classified into rank D. Other batteries are classified into rank B or rank C depending on the degree of deterioration.

The auction computer 11 transmits the vehicle identifier included in the electric vehicle quality information to the vehicle information computer 21, and acquires, from the vehicle information computer 21, the quality information of the vehicle body 32 (the vehicle body quality information), the quality information of the battery 33 (the battery quality information), and the quality rank of the battery (step S4). As described above, the quality information of the vehicle body 32 (the vehicle body quality information) and the quality information of the battery 33 (the battery quality information) are associated with the vehicle identifier of the electric vehicle 31. The vehicle information computer 21 extracts, from the database 22, the vehicle body quality information and the battery quality information associated with the received vehicle identifier, and transmits the above information to the auction computer 11. Moreover, the vehicle information computer 21 determines the quality rank of the battery 33 based on the battery quality information associated with the vehicle identifier, and transmits the quality rank to the auction computer 11.

Subsequently, the auction computer 11 transmits the acquired vehicle body quality information, battery quality information, and quality rank to the exhibition computer 30 (step S5). The vehicle body quality information and the battery quality information can include information that the exhibitor does not know. In addition, the quality rank helps the exhibitor to discover about the state of the battery. The exhibitor refers to the vehicle body quality information, the battery quality information, and the quality rank, and replies, to the auction computer 11, regarding whether to approve the exhibition application via the exhibition computer 30.

When the exhibitor does not approve, the auction computer 11 cancels the auction (step S6: NO, S7). Upon receiving approval from the exhibitor (step S6: YES), the auction computer 11 proceeds to a process of the next step S12 (see FIG. 3).

There is also a case where the auction computer 11 receives the lowest winning bid price desired by the exhibitor, together with approval of the exhibitor. The lowest winning bid price is a price of the electric vehicle 31 including the battery 33. Alternatively, the auction computer 11 may receive the lowest bid price of the vehicle body 32 alone and the lowest bid price of the battery 33 alone. The auction computer 11 that executes steps S6 and S7 functions as an exhibition confirmation unit.

The auction computer 11 that obtains approval from the exhibitor presents the auction page with the electric vehicle quality information, the vehicle body quality information, the battery quality information, and the quality rank (step S12). A message indicating that the electric vehicle 31, the vehicle body 32, and the battery 33 are separately auctioned is also presented on the auction page. When executing step S12, the auction computer 11 functions as an exhibition information presentation unit. When the lowest winning bid price is received from the exhibitor, the lowest winning bid price is also presented on the auction page. Information, such as the electric vehicle quality information, the vehicle body quality information, the battery quality information, and the quality rank, (and the lowest winning bid price) is presented to the bidding computer 40.

An applicant who desires to purchase the electric vehicle 31, the vehicle body 32, or the battery 33 browses the homepage of the auction system 10, selects an item he/she desires to purchase via his/her own bidding computer 40, and inputs a bid price. The auction system 10 receives bid prices from applicants who desire to purchase the item (step S13). The auction system 10 receives bid prices of each of the electric vehicles, the vehicle body alone, and the battery alone. Hereinbelow, the bid price of the electric vehicle will be referred to as the electric vehicle bid price, the bid price of the vehicle body alone will be referred to as the vehicle body bid price, and the bid price of the battery alone will be referred to as the battery bid price. When a plurality of electric vehicle bid prices is received, the highest electric vehicle bid price is simply referred to as the "electric vehicle bid price". Similarly, when a plurality of vehicle body bid prices (the battery bid prices) is received, the highest vehicle body bid price (the highest battery bid price) is simply referred to as the "vehicle body bid price (the battery bid price)".

When a predetermined presentation period (for example, one month) has elapsed since the auction information of the electric vehicle 31, the vehicle body 32, and the battery 33 was presented, the auction computer 11 closes the bidding (step S14). When executing steps S13 and S14, the auction computer 11 functions as a bidding reception unit. In step S15 and thereafter, the auction computer 11 functions as a determination unit.

In step S15, the auction computer 11 compares a total price of the vehicle body bid price and the battery bid price (a vehicle body and battery total bid price) with the electric vehicle bid price (step S15). As described above, when there is a plurality of biddings, the "bid price" means the highest price from among the plurality of bid prices.

When the electric vehicle bid price exceeds the vehicle body and battery total bid price (step S15: YES), the auction computer 11 determines an electric vehicle purchase applicant who has presented the electric vehicle bid price as a winning bidder of the electric vehicle (step S16). Then, the auction computer 11 notifies the winning bidder of the electric vehicle 31 that he/she has won the bidding and notifies the exhibitor that the electric vehicle 31 has been sold at the electric vehicle bid price (step S17).

On the other hand, when the electric vehicle bid price is lower than the vehicle body and battery total bid price (steps S15: NO, S22: YES), the auction computer 11 determines that a vehicle body purchase applicant who has presented the vehicle body bid price is a winning bidder of the vehicle body 32 (step S23). The auction computer 11 determines that a battery purchase applicant who has presented the battery bid price is a winning bidder of the battery 33 (step S23). Then, the auction computer 11 notifies the winning bidder of the vehicle body 32 and the winning bidder of the battery 33 that they have won the biddings and notifies the exhibitors that the vehicle body 32 and the battery 33 have been sold, respectively (step S24).

When the electric vehicle bid price is equal to the vehicle body and battery total bid price (steps S15: NO, S22: NO), the auction computer 11 notifies the exhibitor of the electric vehicle bid price, the vehicle body bid price, and the battery bid price, and determines a winning bidder (step S25). The auction computer 11 notifies the determined winning bidder that he/she has won the bidding (step S26).

When an electric vehicle including a battery is exhibited to a second-hand market, the price of the electric vehicle drops when a value of the battery is low in comparison to when a value of the vehicle body is high. By auctioning the vehicle body and the battery of the electric vehicle separately, it is possible to keep the vehicle body and the battery at appropriate prices, respectively.

Points to be noted associated with the technology described in the embodiment will be described. When the bid price is lower than the highest winning bid price, the auction computer 11 cancels the auction and notifies the exhibitor of the above fact. Alternatively, the auction computer 11 may extend the presentation period in step S14.

When there is no bidding for the electric vehicle, the auction computer 11 may determine the bidder who has presented the vehicle body bid price (the highest bid price from among a plurality of vehicle body bid prices) as the winning bidder of the vehicle body 32, and determine the bidder who has presented the battery bid price (the highest bid price from among a plurality of battery bid prices) as the winning bidder of the battery 33.

The auction system 10 according to the embodiment is the auction computer 11 having the CPU 12 and the memory 13, and the auction computer 11 executes processing hereinbelow. The auction computer presents the computer of the bidder (the bidding computer 40) with the vehicle body quality information indicating the quality of the vehicle body excluding the battery of the electric vehicle and the battery quality information indicating the quality of the battery. The auction computer receives, from the bidding computer 40, the electric vehicle bid price indicating the bid price of the electric vehicle including the battery, a vehicle body bid price indicating the bid price of the vehicle body excluding the battery, and the battery bid price indicating the bid price of the battery. When the total of the vehicle body bid price and the battery bid price exceeds the electric vehicle bid price, the auction computer determines the battery purchase applicant who has presented the battery bid price as the winning bidder of the battery, and the vehicle body purchase applicant who has presented the vehicle body bid price as the winning bidder of the vehicle body. On the other hand, when the total of the vehicle body bid price and the battery bid price is lower than the electric vehicle bid price, the auction computer determines the electric vehicle purchase applicant who has presented the electric vehicle bid price as the winning bidder of the electric vehicle.

The auction system 10 according to the embodiment can also be embodied as a program executed by the auction computer 11. The program causes the computer to function as a next exhibition reception unit, information acquisition unit, exhibition confirmation unit, exhibition presentation unit, bidding reception unit, and determination unit. The exhibition reception unit receives the exhibition application for the electric vehicle from an exhibition applicant. The information acquisition unit acquires electric vehicle information including the identifier of the electric vehicle 31 from the exhibitor. The information acquisition unit transmits the identifier to the management device (the vehicle information computer 21) of the electric vehicle 31, and acquires the information (the vehicle body quality information) on the quality of the vehicle body 32 (the electric vehicle 31 excluding the battery 33), the information (the battery quality information) on the quality of the battery 33, and the quality rank of the battery 33.

The exhibition confirmation unit notifies the exhibitor of the vehicle body quality information, the battery quality information, and the quality rank, and obtains approval for the exhibition. The exhibition presentation unit presents the bidding computer 40 with the electric vehicle quality information, the vehicle body quality information, the battery quality information, and the quality rank.

The bidding reception unit receives, from the bidding computer 40, the electric vehicle bid price indicating the bid price of the electric vehicle 31 including the battery 33, the vehicle body bid price indicating the bid price of the vehicle body 32 excluding the battery 33, and the battery bid price indicating the bid price of the battery 33.

When the total price of the vehicle body bid price and the battery bid price exceeds the electric vehicle bid price, the determination unit determines the battery purchase applicant who has presented the battery bid price as the winning bidder of the battery, and the vehicle body purchase applicant who has presented the vehicle body bid price as the winning bidder of the vehicle body. On the other hand, when the total price of the vehicle body bid price and the battery bid price is lower than the electric vehicle bid price, the determination unit determines the electric vehicle purchase applicant who has presented the electric vehicle bid price as the winning bidder of the electric vehicle.

As described above, the "electric vehicle bid price" means the highest bid price of at least one electric vehicle bid price. The same applies to the "vehicle body bid price" and the "battery bid price". When expressions of "at least one electric vehicle bid price", "at least one vehicle body bid price", and "at least one battery bid price" are used, the auction system 10 according to the embodiment can be expressed as below.

The auction system 10 (the auction computer 11) auctions the electric vehicle 31 having the battery 33 mounted thereon. The auction computer 11 presents the computer of the bidder (the bidding computer 40) with the vehicle body quality information indicating the quality of the vehicle body 32 excluding the battery 33 of the electric vehicle 31 and the battery quality information indicating the quality of the battery 33. The auction computer 11 receives, from the bidding computer 40, at least one electric vehicle bid price indicating the bid price of the electric vehicle 31 including the battery 33, at least one vehicle body bid price indicating the bid price of the vehicle body 32 excluding the battery 33, and at least one battery bid price indicating the bid price of the battery 33. When the total price of the highest price of at least one vehicle body bid price and the highest price of at least one battery bid price exceeds the highest price of at least one electric vehicle bid price, the auction computer 11 determines the battery purchase applicant who has presented the highest price of the battery bid price as the winning bidder of the battery, and determines the vehicle body purchase applicant who has presented the highest price of the vehicle body bid price as the winning bidder of the vehicle body. On the other hand, when the total amount is lower than the highest price of at least one electric vehicle bid price, the auction computer 11 determines the electric vehicle purchase applicant who has presented the highest price of the electric vehicle bid price as the winning bidder of the electric vehicle.

The auction computer 11 receives the identifier of the electric vehicle 31, transmits the identifier to the management device (the vehicle information computer 21) of the electric vehicle, and acquires the battery quality information from the management device. The management device stores the battery quality information in association with the identifier. The auction computer 11 may present the bidding computer 40 with the quality rank indicating the degree of deterioration of the battery 33, which is determined based on the battery quality information.

Alternatively, the auction computer 11 may present vehicle body quality information indicating the quality of the vehicle body 32 excluding the battery 33 of the electric vehicle 31 and battery quality information indicating the quality of the battery 33. The auction computer receives at least one vehicle body bid price indicating the bid price of the vehicle body 32 excluding the battery 33 and at least one battery bid price indicating the bid price of the battery 33. The auction computer 11 may determine the winning bidder of the vehicle body based on at least one vehicle body bid price, and determine the winning bidder of the battery based on at least one battery bid price.

As above, specific examples of the present disclosure have been described in detail, but they are merely examples and do not limit the scope of the claims. The technology described in the claims includes variations and modifications of the specific examples illustrated above. The technical elements described herein or in the drawings exhibit their technical usefulness alone or in various combinations, and are not limited to the combinations described in the claims at the time of application. Further, the technology illustrated in the present specification or drawings can achieve a plurality of purposes at the same time, and achieving one of the purposes itself is technically useful.

What is claimed is:

1. An auction system of an electric vehicle on which a battery is mounted, the auction system comprising:

a memory; and a processor programmed to acquire an identifier of the electric vehicle, transmit the identifier to a management device of the electric vehicle, acquire, from the management device, battery quality information, indicating a quality of the battery, associated with the identifier, present a computer of a bidder with vehicle body quality information indicating a quality of a vehicle body excluding the battery of the electric vehicle, and the battery quality information, receive, from the computer, an electric vehicle bid price indicating a bid price of the electric vehicle including the battery, a vehicle body bid price indicating a bid price of the vehicle body excluding the battery, and a battery bid price indicating a bid price of the battery, determine, when a total of the vehicle body bid price and the battery bid price exceeds the electric vehicle bid price, a battery purchase applicant who presents the battery bid price as a winning bidder of the battery, and a vehicle body purchase applicant who presents the vehicle body bid price as a winning bidder of the vehicle body, and determine, when the total is lower than the electric vehicle bid price, an electric vehicle purchase applicant who presents the electric vehicle bid price as a winning bidder of the electric vehicle.

2. The auction system according to claim 1, wherein the processor is programmed to present, to the computer, a quality rank which indicates a degree of deterioration of the battery and which is determined based on the battery quality information.

3. An auction system of an electric vehicle on which a battery is mounted, the auction system comprising:

a memory; and a processor programmed to acquire an identifier of the electric vehicle, transmit the identifier to a management device of the electric vehicle, acquire, from the management device, battery quality information, indicating a quality of the battery, associated with the identifier, present vehicle body quality information indicating a quality of a vehicle body excluding the battery of the electric vehicle, and the battery quality information, receive at least one vehicle body bid price indicating a bid price of the vehicle body excluding the battery and at least one battery bid price indicating a bid price of the battery, and determine a winning bidder of the vehicle body based on the at least one vehicle body bid price, and a winning bidder of the battery based on the at least one battery bid price.

* * * * *